US006903688B2

(12) United States Patent
Edvardsson

(10) Patent No.: US 6,903,688 B2
(45) Date of Patent: Jun. 7, 2005

(54) ANTENNA DEVICE

(75) Inventor: Olov Edvardsson, Täby (SE)

(73) Assignee: AMC Centurion AB, Akersberga (SE)

( * ) Notice: Subject to any disclaimer, the term of this patent is extended or adjusted under 35 U.S.C. 154(b) by 5 days.

(21) Appl. No.: 10/451,603

(22) PCT Filed: Dec. 21, 2001

(86) PCT No.: PCT/SE01/02884

§ 371 (c)(1),
(2), (4) Date: Dec. 2, 2003

(87) PCT Pub. No.: WO02/054534

PCT Pub. Date: Jul. 11, 2002

(65) Prior Publication Data

US 2004/0087341 A1 May 6, 2004

(30) Foreign Application Priority Data

Dec. 29, 2000 (SE) ..... 0004911

(51) Int. Cl.[7] ..... H01Q 1/38
(52) U.S. Cl. ..... 343/700 MS; 343/702; 343/852
(58) Field of Search ..... 343/700 MS, 702, 343/847, 850, 852

(56) References Cited

U.S. PATENT DOCUMENTS 5,124,733 A 6/1992 Haneishi ..... 343/700 MS
6,268,831 B1 * 7/2001 Sanford ..... 343/702
6,326,921 B1 * 12/2001 Egorov et al. ..... 343/700 MS
6,346,914 B1 * 2/2002 Annamaa ..... 343/700 MS
6,614,400 B2 * 9/2003 Egorov ..... 343/702
6,836,246 B1 * 12/2004 Kadambi et al. .... 343/700 MS

FOREIGN PATENT DOCUMENTS

EP 0932219 A2 7/1999
EP 1052723 A2 11/2000

* cited by examiner

*Primary Examiner*—Shih-Chao Chen
(74) *Attorney, Agent, or Firm*—Holland and Hart LLP

(57) ABSTRACT

An antenna device is adapted for use in at least two frequency bands, wherein the mean wave length of the higher of said frequency bands is λ. The antenna device comprises an antenna element in the form of a reed (10) mounted on a conductive support structure (20) having a projected area of less than $\lambda^2$. The reed comprises a feeding portion (12) connectable to a feed device (32) and at least one impedance is connected between the reed and the conductive support. Also, the phase difference of transmitted and/or received signal waves within said at least two frequency bands over the reed is less than 120° in order to increase radiation con-ductance. A multi-band antenna device with a relatively wide upper frequency band is thereby provided.

19 Claims, 6 Drawing Sheets

ANTENNA DEVICE

FIELD OF INVENTION

The present invention relates generally to antenna devices and more particularly to an internal multi-band antenna device for use in portable radio communication devices, such as in mobile phones.

BACKGROUND

Planar antennas have found a widespread use not the least in the area of mobile communication. A classical type is the basic patch antenna being a square conduction surface with a side length of $\lambda/2$, wherein $\lambda$ is wavelength, see FIG. 1. The conducting surface is provided spaced apart from a ground plane in the form of a very large conducting surface and with air between the conducting surface and the ground plane.

Many derivatives from the basic patch antenna are in use. In one class the basic $\lambda/2$-size is retained but bandwidth has been improved by slots of various shapes, manufacturing has been facilitated, the antenna has been adopted for multi-band use or for different polarizations etc.

Another class of prior art derivatives has a size much smaller than $\lambda/2$ and the improvements in this class have been concentrated to improvements of the usually poor bandwidth and to multi-band performance. The generic name "Small Patch Antennas" or simply SPAs is used herein as a common name for this kind of antennas which is justified by the fact that all small patch antennas have a number of important problems and solutions in common.

The small patch antennas are like most patch antennas resonant structures wherein different means have been used to tune down the frequency from what could be expected from their size. When the main current is restricted to one direction the square patch can be made narrower, as shown in FIG. 2, and its length can also be reduced by 50% by a grounding in the former middle (or ground potential) and cutting one half as shown in FIG. 3. These changes will make the surface considerable smaller than the original $\lambda/2$ by $\lambda/2$, such as a tongue of $\lambda/4$ times $\lambda/10$, see FIG. 3, but this 90% area reduction is achieved at the expense of bandwidth performance. Even a length of $\lambda/4$, corresponding to a length of around 80 mm at the common telephone frequency bands in the 800 to 1000 MHz range, is many times too large for a mobile phone when considering the customers demands for small and light weight telephones.

One common antenna element in the class "small patch antennas" is the PIFA element meaning Planar Inverted F-Antenna, where the F-antenna is a common short-wave antenna type used among radio amateurs. A majority of built in telephone antennas today are said to be of this type or some "modified PIFA" type. The "basic PIFA" is a $\lambda/4$ long strip connected to a ground-plane below the strip at one end and open at the other end. An input connection is located at a place in between the open end and the grounded end to get desired input impedance, which typically is chosen to 50 Ohms. One property common for all resonant structures is that there is a free choice of input impedance by a suitable feeding point. For applications where $\lambda/4$ is too long the length of the PIFA can be made shorter. FIG. 4 shows a basic PIFA configuration. Pure downscaling in size would increase the resonance frequency correspondingly but the resonance frequency can be tuned down in many ways to get the desired resonance frequency. Three typical ways to tune down the frequency are 1) by using a higher dielectric constant as insulation, 2) by loading the open end with a capacitor, and 3) by introducing inductance along the PIFA-strip, for instance, by giving it a meandering shape. When subsequently the PIFA concept is referred to some of these detuning means are assumed making the typical length well below $\lambda/4$.

The decreased size of the element will in all cases imply a smaller bandwidth and as a general trend the bandwidth-efficiency product $(\Delta f/f)\eta$ will be proportional to the volume of the antenna element as expressed in the third power of the wavelength. This has a similarity with the classical Wheelers antenna size limitation stating that $(\Delta f/f)\eta<13V/\lambda^3$, wherein Wheelers limitation applies for the whole radiating structure and V is the volume of the smallest sphere enclosing the structure.

The basic PIFA has a typical admittance structure (i.e. a parallel resonant circuit) when measured over the open end and by moving the input connection closer to the short-circuited end the input impedance can be adjusted to for example 50 ohms. The reactive part of the admittance (the suceptance) is not much dependent of the surrounding such as the size of the ground plane below the PIFA but it is much dependent of the stored energy within the resonant structure. A smaller distance between the strip and the ground plane will for instance give the suceptance a larger variation with the frequency around the resonance frequency where the suceptance is 0. If the strip is much shorter than $\lambda/4$ the bandwidth will likewise be smaller and in general terms the upper limit for the bandwidth will be proportional to the volume of the antenna element. The real part of the admittance (the conductance) is very important for the SPAs and the bandwidth will be proportional to the conductance, which is mainly radiation conductance with losses as an undesired additional component.

However, one problem with a typical PIFA is that the radiation conductance is difficult to control. Another problem with the original PIFA is that it is not well suited for multi-band applications, partly because the PIFA by definition is planar.

The last few years several PIFAs modified for dual-band telephone service has entered the market. The by far most common principle is to remove parts of the conduction surface to create a second resonance around for instance 1800 MHz beside a first one around 900 MHz. One basic type of modified PIFA is the so-called C-PIFA, wherein in a figurative way a thick "I" is replaced by a "C" formed by cutting away a part of a square or rectangular conduction surface, see FIG. 5. Typically the same relative bandwidth is obtained at the upper band as at the lower which is what is needed for example GSM 900/1800. The result is however much less than could be expected by Wheelers limitation. Thus, in the modified PIFA a large number of different patterns derived from I and C quoted above have been used but more or less of them have given limited results. The typical need for the higher frequency bands for a modern mobile phone is much bigger. For instance, not only GSM 1800 should be covered but also GSM 1900 and UMTS making 1700–2300 MHz a desired band. This is 30% relative bandwidth as compared to 8% for GSM 900 or GSM 1800.

SUMMARY OF THE INVENTION

An object of the present invention is to provide an antenna device of the kind initially mentioned wherein the frequency characteristics provides for at least two comparatively wide frequency bands.

Another object is to provide a dual-band antenna device with a wide bandwidth at the higher frequency band.

Still another object of the present invention is to provide an antenna device with a better use of a limited space than prior art devices.

Yet another object is to provide an antenna device having better multi-band performance than prior art devices.

A further object is to provide an antenna device that is easy and inexpensive to manufacture.

The invention is based on the realization that the coupling to the supporting structure is a critical factor for getting a usable band width of the frequency bands and that the bandwidth is narrowed by the fact that the phase of the signals is spread too much across the surface of the antenna element. As compared to prior art there are provided elements that increase the coupling to the support structure, which is the phone itself. By this increased coupling less current amplitudes will be needed for a specified useful power giving better bandwidth and less near zone losses. Also, by giving the antenna element or reed suitable coupling to a support structure, the phase of the signals can be kept within a sufficient range.

According to the invention there is provided an antenna device as defined in claim 1.

There is also provided a portable radio communication device as defined in claim 13.

Further preferred embodiments are defined in the dependent sub-claims.

The invention provides an antenna device wherein the problems in prior art devices are avoided or at least mitigated. Thus, there is provided a multi-band antenna device with a relatively wide upper frequency band.

BRIEF DESCRIPTION OF DRAWINGS

The invention is now described, by way of example, with reference to the accompanying drawings, in which.

DETAILED DESCRIPTION OF THE INVENTION

In the following, a detailed description of embodiments of an antenna device according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details.

It is recognized that in prior art documents the term "ground plane" is often used in connection with smaller surfaces. However, the size of the "ground plane" is a quite important condition for the present invention and therefore the distinction is done below that the term "ground plane" is reserved for large structures (diameter>=10λ) while the term "support structure" is used for small structures (diameter<10λ). The support structure is the conductive part to which the antenna element is attached.

Also, in this description the expression "Small Patch Antenna" or simply "SPA" refers to any kind of patch-like antenna element having a surface which is an order of dignity less than $0.25\lambda^2$. At a frequency of 1000 MHz, for example, the wavelength is 300 mm and consequently $0.25\lambda^2$ equals 225 $cm^2$.

Throughout this description, the term "antenna element" or "radiating element" should be construed as to cover any antenna element adapted to receive or transmit electromagnetic waves.

"Feeding point" is where a connection to the antenna element is made.

The terms "Feeding end" and "open end" are used in case an elongated antenna element is employed and are not depending on how "open" the open end is.

The new antenna element uses new principles for the multi-band performance and the name "Loaded Reed Antenna" or "LRA" is proposed and subsequently used. The term "reed" is derived from the word common to a class of music instruments where the reed creates a sound, which is tuned by surrounding elements "loading" the reed.

The wavelength λ in meter is 300/f, wherein f is the frequency in MHz. For a frequency between 800 and 2500 MHz the wavelength varies between 375 and 120 mm. Subsequently the wavelength refers to the used frequency unless otherwise stated. As the frequency of the high band for the mobile telephones generally is 2–2.5 times the frequency for the lower band the frequency of the high band is in some places used as a reference as the high band behavior of the LRA is a significant difference to prior art.

FIGS. 1–5 have been discussed in connection with the prior art description and will not be dealt with further.

Figure 1:
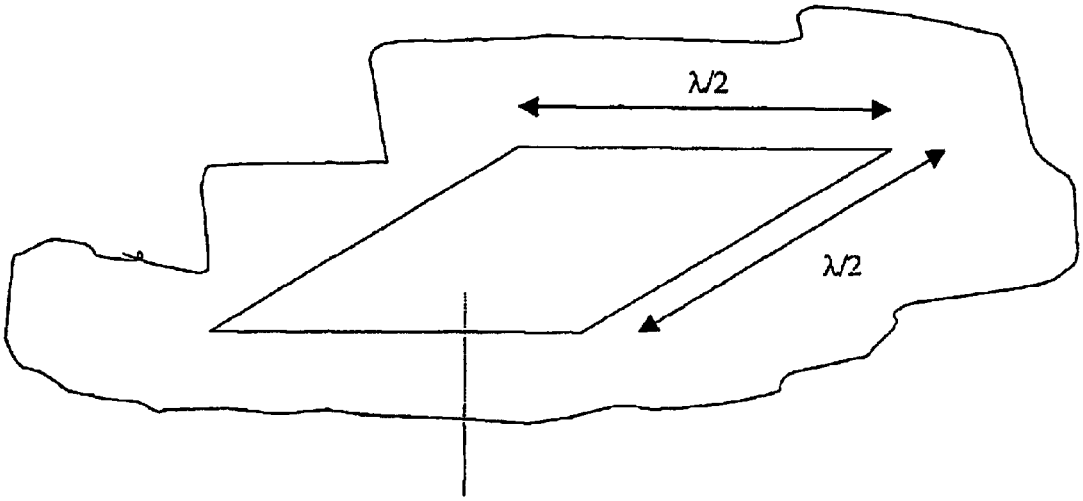
Fig. 1 (Prior Art)
FIG. 1 shows a prior art device in the shape of a patch antenna.
Figure 2:
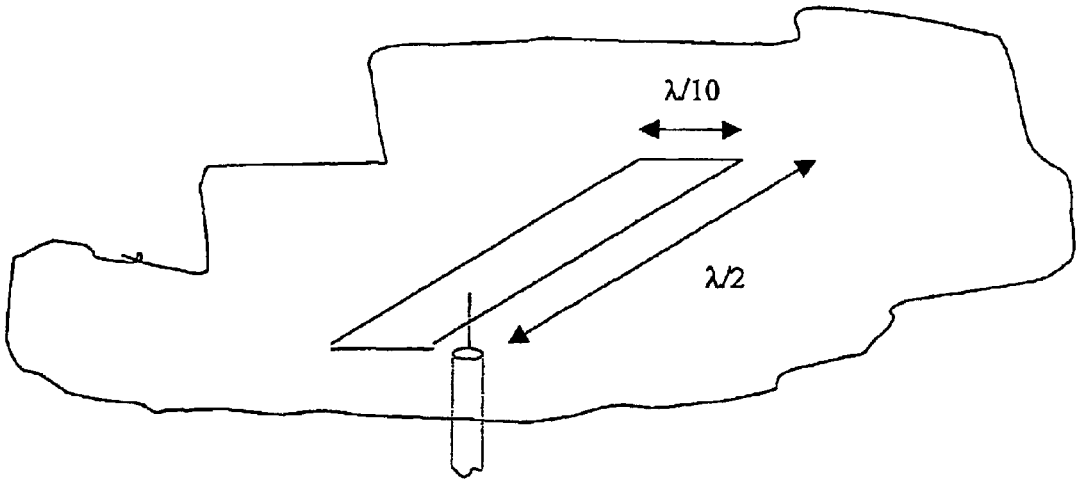
Fig. 2 (Prior Art)
FIG. 2 shows another prior art device in the shape of a narrow patch.
Figure 3:
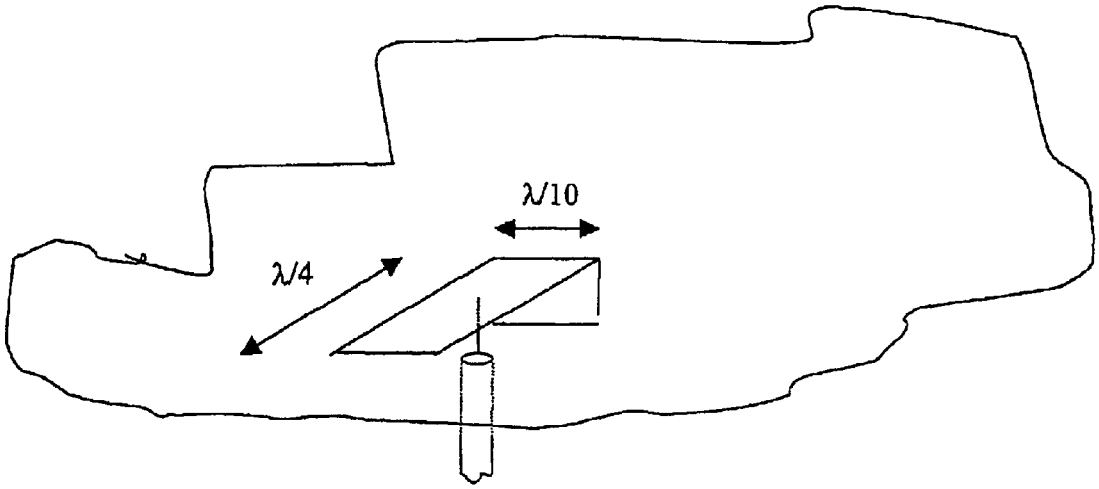
Fig. 3 (Prior Art)
FIG. 3 shows another prior art device in the shape of a narrow patch cut and grounded in the middle.
Figure 4:
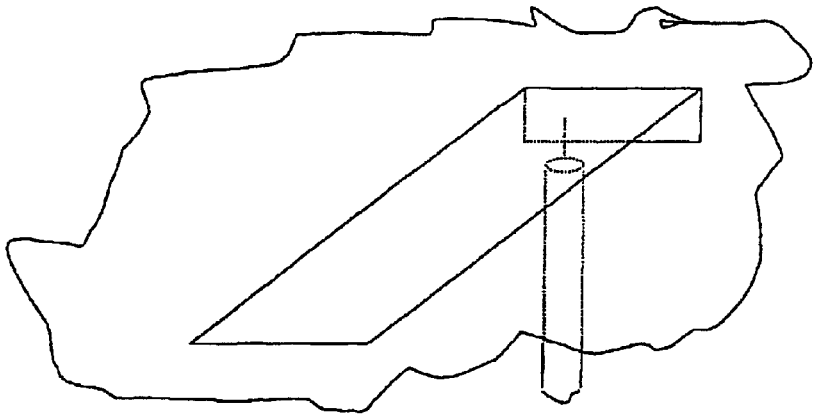
Fig. 4 (Prior Art)
FIG. 4 shows a plan view of another prior art device in the shape of a basic PIFA.
Figure 5:
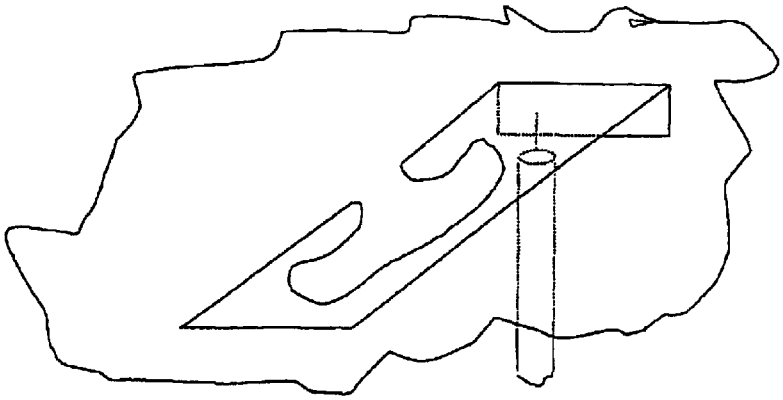
Fig. 5 (Prior Art)
FIG. 5 shows another prior art device in the shape of a C-PIFA.
Figure 6:
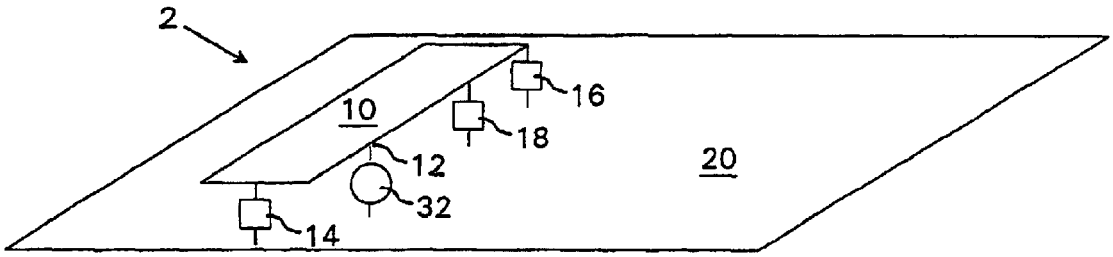
FIG. 6 is a perspective view of a first embodiment of an antenna device according to the present invention.

A first embodiment of an antenna device according to the invention will now be described with reference to FIG. 6, which is a schematic side view of a Loaded Reed Antenna (LRA). The antenna, generally designated 2, comprises a generally planar conduction element or reed 10. The reed 10 is positioned spaced apart from a support structure, generally designated 20. The support structure typically comprises a printed circuit board with circuits for a radio communication device in which the antenna is mounted. The projected surface of the supporting structure 20 is preferably 0.01–0.5 $\lambda^2$, more preferably 0.03–0.25 $\lambda^2$, and most preferably 0.05–0.10 $\lambda^2$, wherein λ prefers to the used wavelength and the direction of projection is perpendicular to the general extension of the support structure. This provides for a better bandwidth compared to what would be obtained with a larger grounding plane. The effective antenna is generally the supporting structure itself so any means to enhance the coupling between the SPA and the supporting structure are important.

In between the reed 10 and the support structure 20 there is a space filled with air and some suitable structural detail keeping the reed and the support structure at a fixed mutual distance, such as a plastic piece.

Figure 7:
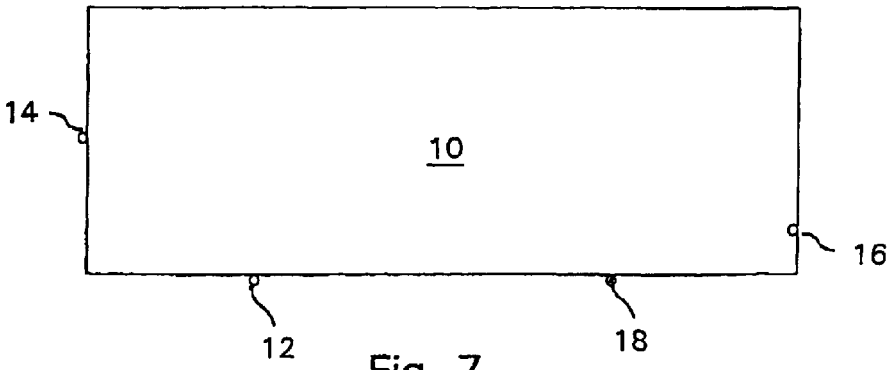
FIG. 7 is a plan view of a reed comprised in the antenna device shown in FIG. 6.

The reed 10 is made of some suitable conductive material and has an elongated or a generally rectangular shape when view from the above, see FIG. 7. The reed 10 preferably has a length L of approximately 40 millimeters when measured from one end to the other and a width W of about 20 millimeters, but other sizes are also feasible, depending on space limitations, performance requirements etc. Somewhere between the end portions of the reed 10 there is provided an input connection 12 connected to a feed device 32 of the mobile phone in which the reed is mounted. However, there is no grounding of reed 10 as there is no ground plane per se.

Instead, at one end of the reed 10 there is provided an electrically conductive connection 14 to the support structure 20. This and all impedances between the reed and the support structure are preferably substantially greater than zero. The electrical properties of the connection 14 can be either inductive or capacitive. By close control of the impedances between the reed and the support structure, all portions of the reed is given essentially equal radiating coefficients.

A critical factor for the bandwidth and efficiency is to get a good coupling or coupling coefficient between the reed and the support structure of the radio communication device. An important coupling function is that the reed functions like a flattered monopole pointing out from the support structure. The basic measure for such a flattered monopole is the surface but due to practical and aesthetic limitations the surface is many times smaller than would be desired from purely functional considerations. The way to make the effective surface as efficient as possible is to ensure that all parts of the surface has a uniform electrical phase, i.e., the phase difference of transmitted and/or received signal waves within the operating frequency bands over said is less than 120°, more preferably less than 90°, even more preferably less than 60°, and most preferably less than 30°.

Following FIG. 7 the reed is a more or less continuous metal surface in contrast to a typical C-PIFA, for example. "Continuous" is here to be understood in electrical terms, including such shapes as a meander pattern filling the contour of the reed.

At a second end of the reed 10 opposite to the end with the connection 14 there is provided a load 16 between the reed 10 and the support structure 20. By means of the load 16, the coupling to a small supporting structure can be controlled and thus the radiation conductance can be increased. Thus, an important feature of the inventive device is an increased radiation conductance by means of an improved coupling to the supporting structure. This is obtained by the utilization of both electric and magnetic coupling from the antenna element to the support structure. The loading circuits comprised in the load 16 are adapted to give the electrical amplitude a similar phase over the entire surface of the reed 10.

A third load 18 is provided for increased possibility for frequency dependence adjustment. In that way, the coupling to the support structure is increased, thereby increasing the radiation conductance of the LRA. In this embodiment the load 14 is usable for impedance matching while the load 16 mainly tunes the upper frequency band.

In other words, the electrical amplitude over the reed have the same sign which can be expressed as a phase difference less than 120°, as described above, by which it is avoided to have counteracting between different parts. This is particularly efficient at the higher frequency band where a complicated structure would give counteracting parts.

Some key user parameters for the SPA class are size, bandwidth and efficiency. Typical for all antennas in this class is that the bandwidth efficiency-product will be roughly proportional to the volume of the antenna element, i.e. it will be too small for a very small antenna element. This can be understood as a combination of two effects. The radiation conductance (or resistance) rapidly goes down with the size and the stored energy in the element goes up when the size is smaller and the amplitudes has to increase to maintain the same radiated power in spite of the decreased radiation conductance.

Thus, the LRA principle enables a better control of the radiation conductance, which is an important difference to prior art. An advantage of the improved radiation conductance is lower currents around the antenna element for the same radiated power. This will decrease the near zone losses in material close to the phone such as hand and head of the user.

The bandwidth can coarsely be estimated as proportional to the quotient between radiated power and the stored energy. In terms of admittance the radiated power is proportional to the radiation conductance while the stored energy is proportional to corresponding capacitance or rather suceptance.

However, resonance is a pure impedance condition which should not seen as closely tied to the size or different lengths of the antenna and neither it is an important factor to create radio radiation from the antenna. The size is important for the radiation but not for the resonance. Thus any antenna length smaller than $\lambda/4$ can be tuned to the used frequency by for instance adding a suitable capacitor over the open end or an inductance along the tongue. Typical for all resonant antenna structures is that it is easy to find any desired real input impedance level by a suitable choice of feeding point. A potential disadvantage of the resonant structure is that the bandwidth generally will be decreased by the energy stored in the resonance. Really wide band antennas are not resonant.

Another feature of the inventive device is less stored energy, which further increases the bandwidth.

A second embodiment of an antenna device according to the invention will now be described with reference to FIG. 8, which is a view similar to that of the first embodiment shown in FIG. 6. Like part in the two figures have been given the same reference numerals.

Figure 8:
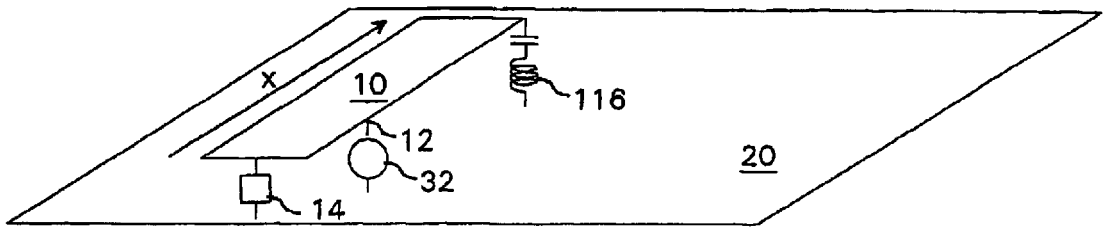
FIG. 8 shows a second embodiment of an antenna device according to the present invention.

Thus, the LRA shown in FIG. 8 comprises a reed 10 with an input connection 12 connected to a feed source 32. There is also a support structure 20 spaced apart from the reed 10.

However, in contrast to the first embodiment, the load 18 is omitted. Also, there are loading impedances 114, 116 at both ends of the reed. This creates a current loop giving a magnetic coupling to further increasing the coupling to the support structure provided the phase is properly chosen.

The LRA is a multi-band antenna, preferably a dual band antenna. In such antennas, both frequency bands must work properly. One way to obtain that is to provide an impedance as a series resonance circuit.

Figure 9A:
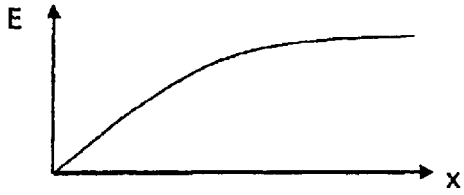
FIGS. 9*a* and 9*b* show field distributions for the antenna device shown in FIG. 8 for the lower and the higher frequency band, respectively.
Figure 9B:
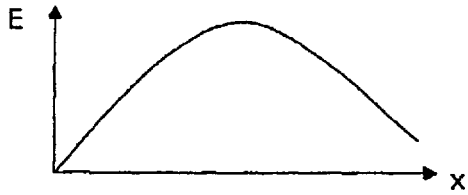

Thus, in this second embodiment the load 116 is provided as a series resonance circuit and has considerably lower impedance at the higher frequency band compared to at the lower frequency band. Simplified is could be expressed as the resonance pattern looking like a $\lambda/4$ resonance at the lower band and as a $\lambda/2$ resonance at the higher band. FIGS. 9*a* and 9*b* indicate typical field patterns along the x-axis of the reed, see FIG. 8. In FIG. 8 a LC series resonance circuit is shown but a corresponding distributed circuit, such as a shorted piece of transmission line with a length of half a wavelength, can also be use.

At the low frequency band the sign of the electrical field will be more or less the same but at the higher band the multiple connections to the support structure by several impedances are used to control the amplitude over the surface.

Figure 10:
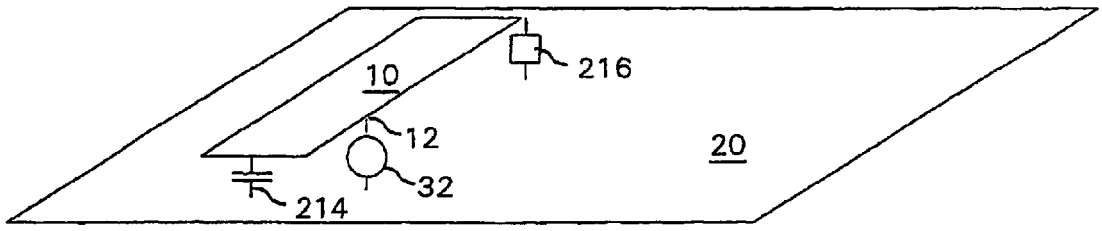
FIG. 10 shows a third embodiment of an antenna device according to the present invention.

A third embodiment of an antenna device according to the invention will now be described with reference to FIG. 10, which is a view similar to that of the first and second embodiments shown in FIGS. 6 and 8, respectively. However, the connection 14 in FIG. 6 between the reed 10 and the support structure 20 has been replaced by a capacitance 214 at the feeding end. This will make it simpler to get a good match at the two frequency band of a multi-band antenna, as the high band typically requires a lower impedance in this element.

It is important that the volume taken up by an antenna is used in an optimum way, as the volume is some kind of quality factor for the antenna. Thus, a planar shape is far from ideal for obtaining the best characteristics possible.

Figure 11:
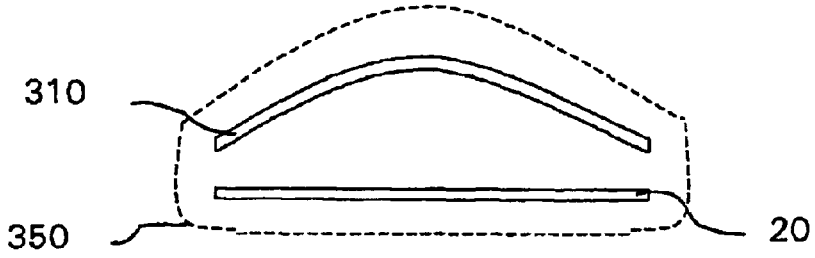
FIGS. 11, 12 and 13 show alternatively shaped reeds comprised in an antenna device according to the invention.

By its way of working the reed of an LRA need not be a planar circuit but can rather be shaped after the enclosure of the mobile phone etc. In FIG. 11, an LRA is shown wherein the reed 310 is shaped to fit the design of the surroundings, in the shown example a telephone housing 350. Thus the reed 310 is slightly vaulted and placed above the support structure 20.

Figure 12:
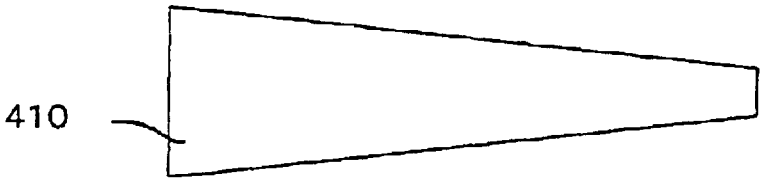

This is a typical case wherein the geometry is non-uniform. This functions as a supplementary element for adjusting the quotient between the higher and lower frequency band. With a reed being uniform in its longitudinal direction, like the one in FIG. 7, the relationship between the lower and the upper frequency bands is as 1:3. However, with a non-uniform reed, like the one 410 shown in FIG. 12, this relationship can be changed to for instance 1:2. Together with the load impedances this gives a better control over the frequency dependence of the LRA.

Figure 13:
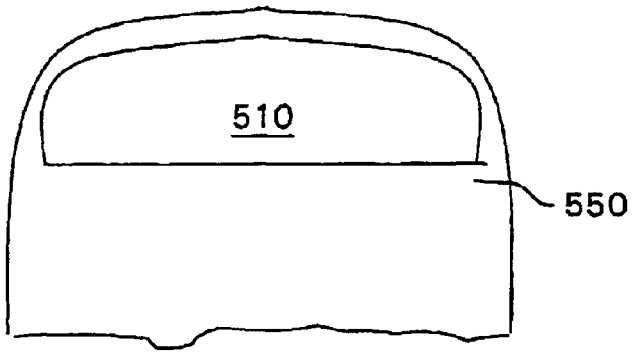

The reed 10 shown in FIG. 7 had a rectangular shape. However, any generally elongated shape is possible. Thus, in FIG. 13 there is shown a plan view of another reed 510. It is here seen that the outline of the reed forms a smooth curve adapted to the configuration of a telephone housing 550.

An important practical circumstance is that the phone is a half wave or full wave antenna by itself. At 800–1000 MHz half a wavelength is around 160 mm while the frequency bands within 1700–2000 MHz have one full wavelength in the same order. This is used with the invention where coupling can be optimized for each frequency band.

Figure 14:
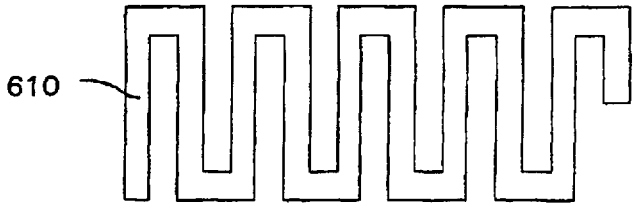
FIG. 14 shows a meander shaped reed.

One feature, which may be adopted to any of the above-described embodiments, is to shape the reed in a meander like pattern 610, see FIG. 14. If the reed is seen as a transmission line this will slow down the wave velocity making a $\lambda/4$ function possible within a much more limited space. It should be stressed that a slower velocity accomplished by the meander shape (adding inductance) will increase the bandwidth as compared to a higher dielectric constant (=adding capacitance) by decreasing the stored energy. The meander line in FIG. 14 can be straight or can have non-uniform measures comparable to FIG. 12.

Figure 15A:
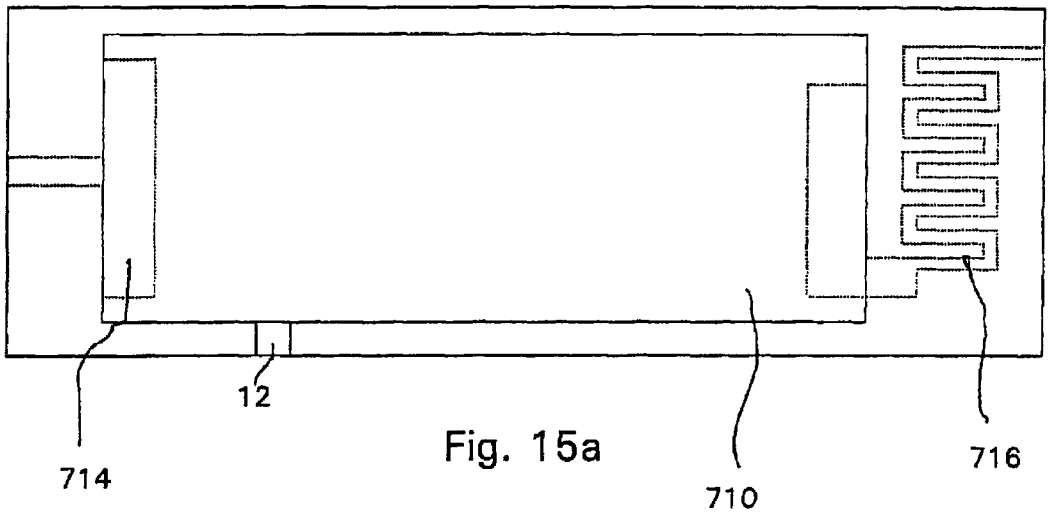
FIGS. 15*a* and 15*b* show an embodiment corresponding to FIG. 8 made of a two-sided printed circuit film.
Figure 15B:
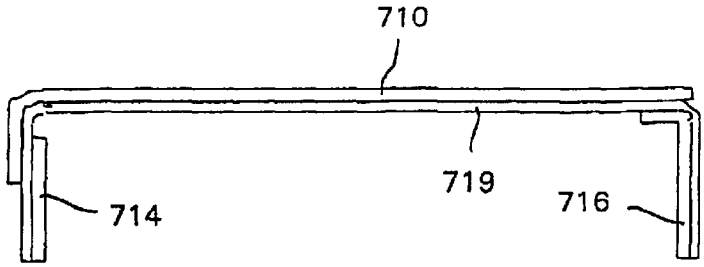

The electrical circuits described herein can be implemented in many ways, including on rigid printed circuit boards (PCBs), flexible PCBS, folded around a piece of insulating material and a piece of polymer with integrated conductors, created by means of a so-called MID process (MID—Moulded Interconnect Devices), for example. A flexible PCB with two sided circuits or even multilayer seems to be particularly well suited as both capacitors and inductors can be readily manufactured in a low cost way. FIG. 15*a* shows a plan view of an example thereof while FIG. 15*b* is a side view of the reed portion shown in FIG. 15*a* when the end portions thereof have been bent 90° downward. A generally rectangular reed 710 is provided on the upper surface of a flexible PCB 719. The reed is provided with a feeding portion 12 connectable to a feed device of a radio communication device. Two load portions 714, 716 are provided on a respective end portion of the lower surface of the PCB 719 and in electrical connection with the reed 710. The first load 714 is provided as a generally straight strip giving is a capacitive property while the second load 716 is provided as a meander giving it a series resonant property. Both loads are adapted to be connected to an underlying conductive support structure (not shown in FIGS. 15*a* and 15*b*).

Preferred embodiments of an antenna device according to the invention have been described. However, it will be appreciated that these can be varied within the scope of the appended claims. Thus, the impedances between the reed and the support structure can for instance be implemented either as lumped elements, distributed circuits (pieces of transmission lines) or external components and not the least while using a multilayer sheet like in FIG. 15 many standard ways to implement the functions are available.

The space between the reed and the support structure has been described to be filled with air. However, any suitably shaped dielectric can be provided.

In the figures the reed is shown oriented parallel to the upper edge of the support structure but an orientation parallel to the sides of the support structure is also possible as the surface of the reed is more essential than the location thereof. This means that also non-parallel orientations of the reed are feasible.

What is claimed is:

1. An antenna device for use in at least two frequency bands, wherein the mean wave length of the higher of said frequency bands is $\lambda$, characterized in that:

said antenna device comprises an antenna element in the form of a reed (10; 310; 410; 510; 610; 710), wherein said reed is mounted on a conductive support structure (20) having a projected area of less than $\lambda^2$, said reed comprises a feeding portion (12) connectable to a feed device (32);

at least one impedance (14, 16, 18; 214, 216; 714, 716) is connected between said reed and said conductive support, and a phase difference of at least one of the transmitted signal waves and received signal waves within said at least two frequency bands over said reed is less than 120° in order to increase radiation conductance.

2. The antenna device according to claim 1, wherein said phase difference is less than 90°.

3. The antenna device according to claim 1, wherein said at least one impedance (14, 16, 18; 214, 216; 714, 716) has a characteristic such as to provide said phase difference.

4. The antenna device according to claim 1, wherein said reed (10; 310; 410; 510; 610; 710) has a shape such as to provide said phase difference.

5. The antenna device according to claim 1, wherein said at least one impedance has an impedance value substantially greater than zero.

6. The antenna device according to claim 1, wherein said feeding portion (12) is provided closer to a first end portion of said reed (10) than a second end portion of said reed opposite of said first end portion.

7. The antenna device according to claim 1, wherein at least one of said at least one impedance is a capacitive impedance (214).

8. The antenna device according to claim 7, wherein said capacitive impedance (214) is provided at said first end portion.

9. The antenna device according to claim 1, wherein said reed has a non-uniform to said support structure.

10. The antenna device according to claim 1, wherein multi-frequency tuning to at least two frequency bands is achieved by a combination of two or more impedances of said at least one impedance and the configuration of said reed.

11. The antenna device according to claim 1, wherein multi-frequency tuning to at least two frequency bands includes said at least one impedance being located at an end portion of said reed, said impedance being substantially higher at a lower frequency band than at a higher frequency band.

12. The antenna device according to claim 1, comprising a flexible substrate (719), wherein said reed (710) is provided on a first surface of said substrate, and wherein said at least one impedance comprises two conductive load portions (714, 716) provided on a second surface of said substrate opposite to said first surface and in electrical contact with said reed (710), said load portions being connectable to a conductive support structure.

13. The antenna device according to claim 1 further comprising a housing for a portable radio communication device and RF circuitry the antenna device mounted in said housing and connected to said RF circuitry.

14. The antenna device according to claim 1, wherein said phase difference is less than 60°.

15. The antenna device according to claim 1, wherein said phase difference is less than 30°.

16. The antenna device according to claim 1, wherein said reed has a non-uniform geometry to said support structure.

17. The antenna device according to claim 1, wherein said reed has a non-uniform distance to said support structure.

18. An antenna device for use in at least two frequency bands, wherein the mean wave length of the higher of said frequency bands is $\lambda$, characterized in that:

said antenna device comprises an antenna element in the form of a reed (10; 310; 410; 510; 610; 710), wherein said reed is mounted on a conductive support structure (20) having a projected area of less than $\lambda^2$, said reed comprises a feeding portion (12) connectable to a feed device (32); and means for altering a phase of at least one of the transmitted signal waves and the received signal waves within said at least two frequency bands over said reed, such that the phase difference is less than 120° in order to increase radiation conductance.

19. The antenna device according to claim 18, wherein the means for altering a phase comprises at least one of a configuration of the reed and at least one impedance.

* * * * *